US006605023B1

(12) United States Patent
Mobley

(10) Patent No.: US 6,605,023 B1
(45) Date of Patent: Aug. 12, 2003

(54) ADJUSTABLE WEIGHTLIFTING BEND

(75) Inventor: Mitch T. Mobley, Jefferson, IA (US)

(73) Assignee: Conner Athletic Products, Inc., Jefferson, IA (US)

( * ) Notice: Subject to any disclaimer, the term of this patent is extended or adjusted under 35 U.S.C. 154(b) by 40 days.

(21) Appl. No.: 09/688,618

(22) Filed: Oct. 16, 2000

(51) Int. Cl.[7] ..... A63B 26/00
(52) U.S. Cl. ..... 482/142; 482/908
(58) Field of Search ..... 482/142, 92–97, 482/104; 5/658, 509.1, 510

(56) References Cited

U.S. PATENT DOCUMENTS 5,833,585 A * 11/1998 Jones et al. ..... 482/97
5,989,168 A * 11/1999 See ..... 482/142
5,993,360 A * 11/1999 Stevens ..... 482/104
5,993,363 A * 11/1999 Chen ..... 482/138
6,264,586 B1 * 7/2001 Webber ..... 482/104
6,287,243 B1 * 9/2001 Isom et al. ..... 482/142
6,296,596 B1 * 10/2001 Alessandri et al. ..... 482/100

OTHER PUBLICATIONS

Wynmor Catalog, Husker Power Rack, p. 9.*
"York Barbell Sports Performance Series" Brochure.
"Husker Power Rack" brochure, Wynmor Fitness Systems, Topeka, KS.
"Life Fitness® Strength Multi Adjustable Bench" brochure, 1998 Life Fitness.

* cited by examiner

*Primary Examiner*—Nicholas D. Lucchesi
*Assistant Examiner*—Lori Baker Amerson

(57) ABSTRACT

An adjustable weightlifting bench includes a base, a backrest pivotally mounted on the base for movement between a plurality of angled positions, and a seat pivotally mounted on the base for movement between a plurality of angled positions. A linkage assembly interconnects the backrest and the seat, such that seat moves automatically and simultaneously when the backrest position is adjusted. The upper surface of the seat is free from obstruction by the backrest in all positions of the backrest.

25 Claims, 5 Drawing Sheets

ADJUSTABLE WEIGHTLIFTING BEND

BACKGROUND OF THE INVENTION

Weightlifting benches having a separate seat and backrest are well known. Typically, the seat and backrest are independently adjustable from a flat position to an angled or inclined position for use in weightlifting. However, such adjustable weightlifting benches normally have a relatively large space or gap between the seat and backrest when the backrest and seat are in a flat horizontal position. Also, in some prior art weightlifting benches, when the backrest is angled upwardly, it overlies a portion of the seat, thereby reducing the surface area of the seat. Thus, a weightlifter cannot sit as comfortably, since he or she is moved forwardly on the seat due to the position of the backrest over the seat.

Accordingly, a primary objective of the present invention is the provision of an improved adjustable weightlifting bench wherein the seat and backrest move in unison.

Another objective of the present invention is the provision of an adjustable weightlifting bench wherein the seat automatically moves to the proper position when the backrest is moved to a desired position.

A further objective of the present invention is the provision of an adjustable weightlifting bench wherein the seat is not obstructed by the backrest in any position.

Another objective of the present invention is the provision of an adjustable weightlifting bench wherein the backrest and seat can be quickly and easily moved to a desired angular orientation.

Another objective of the present invention is the provision of an adjustable weightlifting bench including a spotter platform.

Still another objective of the present invention is the provision of an adjustable weightlifting bench including wheels for moving the bench to a desired location.

Another objective of the present invention is the provision of an adjustable weightlifting bench which can be attached to a weightlifting rack, and being adjustable for proper positioning in the rack.

A further objective of the present invention is the provision of an adjustable weightlifting bench which may be conveniently and easily adjusted.

These and other objectives will become apparent from the following description of the invention.

SUMMARY OF THE INVENTION

An adjustable bench for weightlifting includes a base for supporting the bench on the floor, with an adjustable backrest and seat. A first support member extends between the backrest and the base, pivotally supporting the backrest on the base. A second support member having a plurality of notches adapted to be received on a catch on the base extends between the backrest and the base for positioning the backrest in a selected angular orientation relative to the base. An arm extends between the seat and the base for pivotally supporting the seat on the base. A linkage assembly pivotally connects the backrest, the seat, and the first support member such that the seat automatically and simultaneously adjusts as the backrest is moved to a selected angle. The linkage assembly includes a pair of spaced apart plates having a forward end pivotally connected to the seat and a rearward end pivotally connected to the first support member. The linkage assembly further includes a shaft having an upper end connected to the backrest and a lower end connected to the plates so as to pivotally connect the backrest to the plates. In all of the positions of the backrest and seat, including a flat horizontal position, the space between the backrest and the seat is minimal. The seat remains free from obstruction by the backrest in all positions.

DETAILED DESCRIPTION OF THE DRAWINGS

Figure 1:
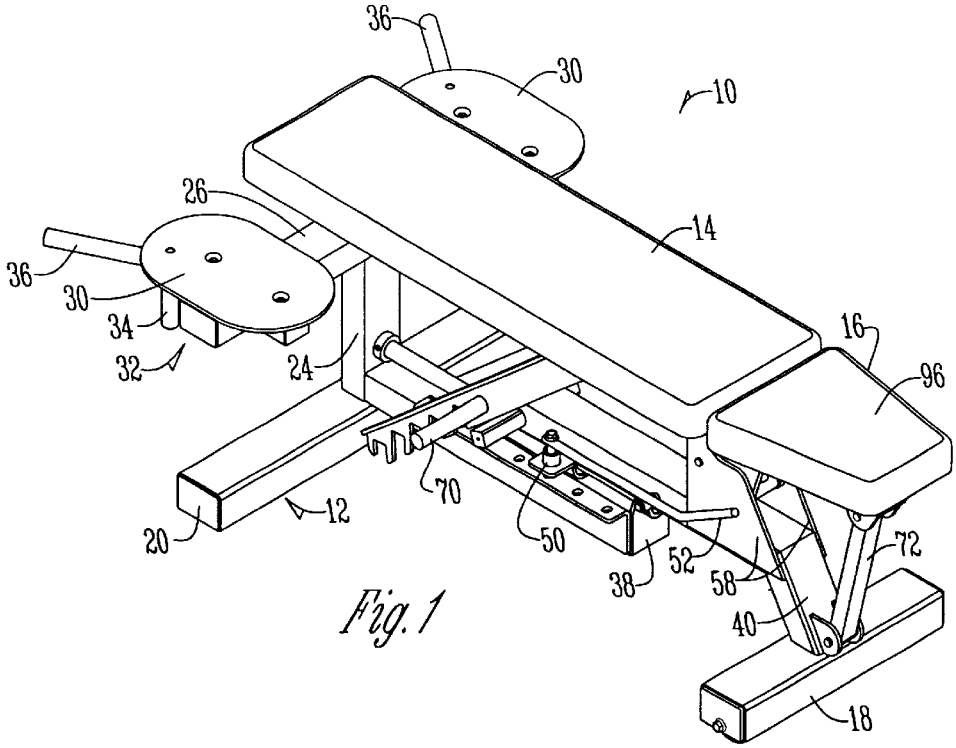
FIG. 1 is a perspective view of the adjustable weightlifting bench of the present position with a backrest and seat being in a flat horizontal position.
Figure 2:
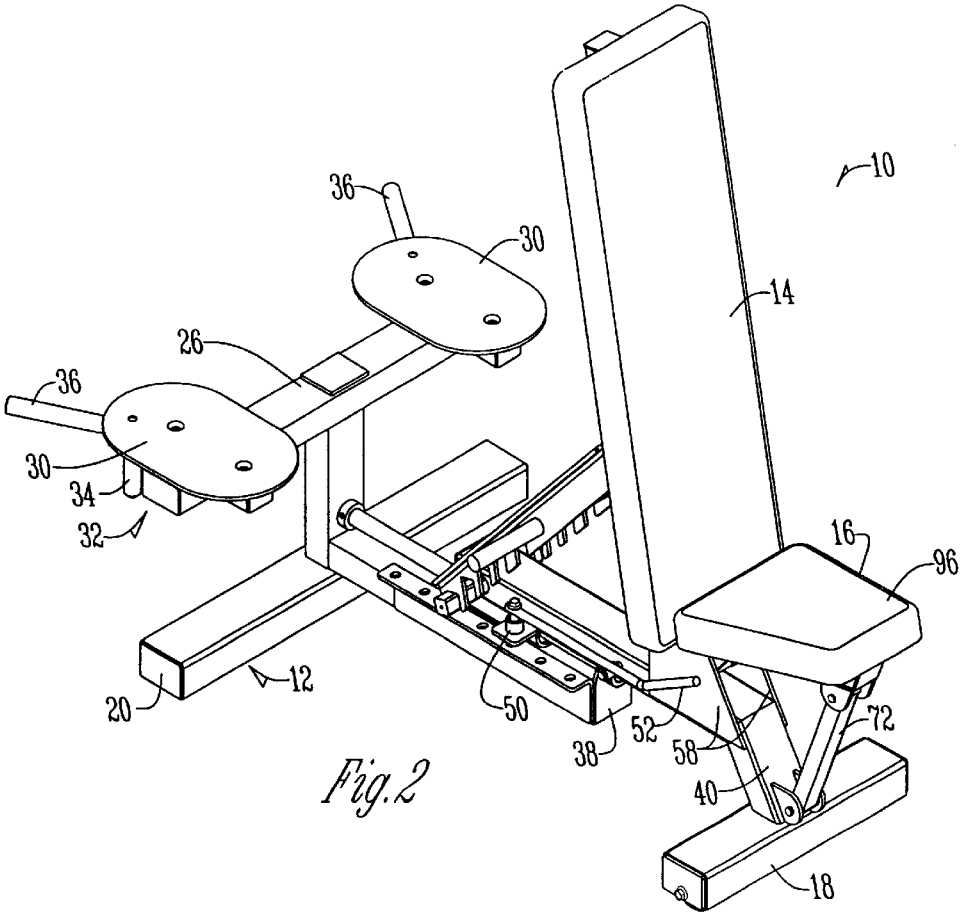
FIG. 2 is a view similar to FIG. 1 showing the backrest moved to an angular position of approximately 80°.
Figure 3:
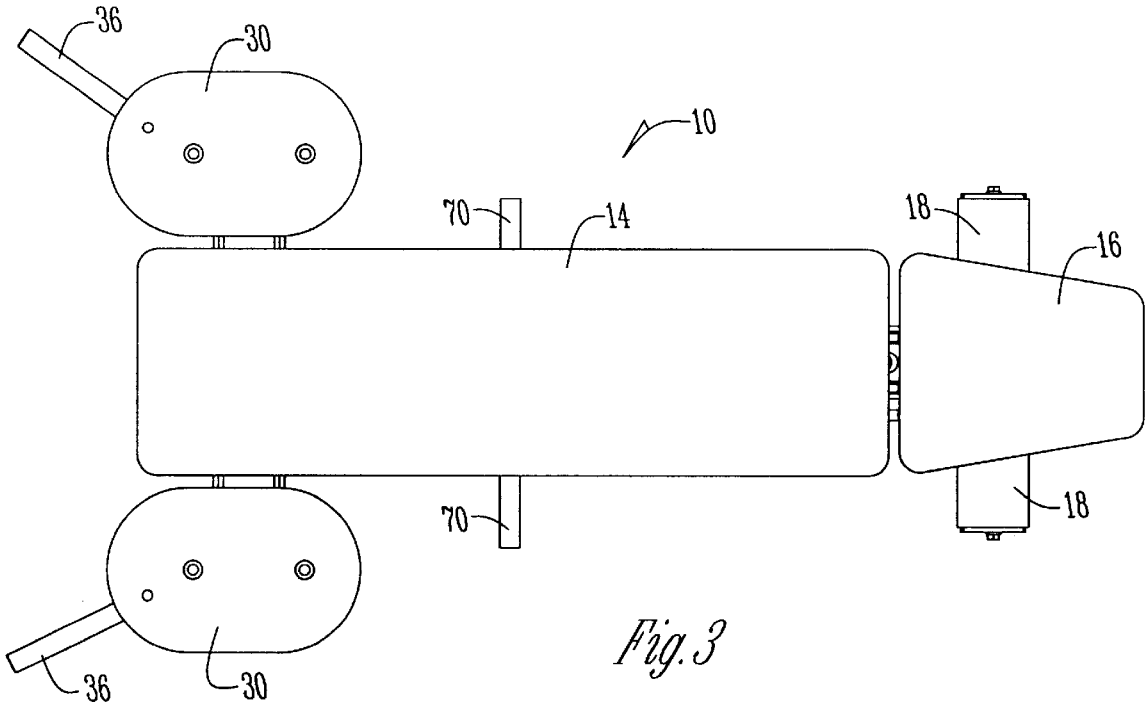
FIG. 3 is a top plan view of the bench at zero degree.
Figure 4:
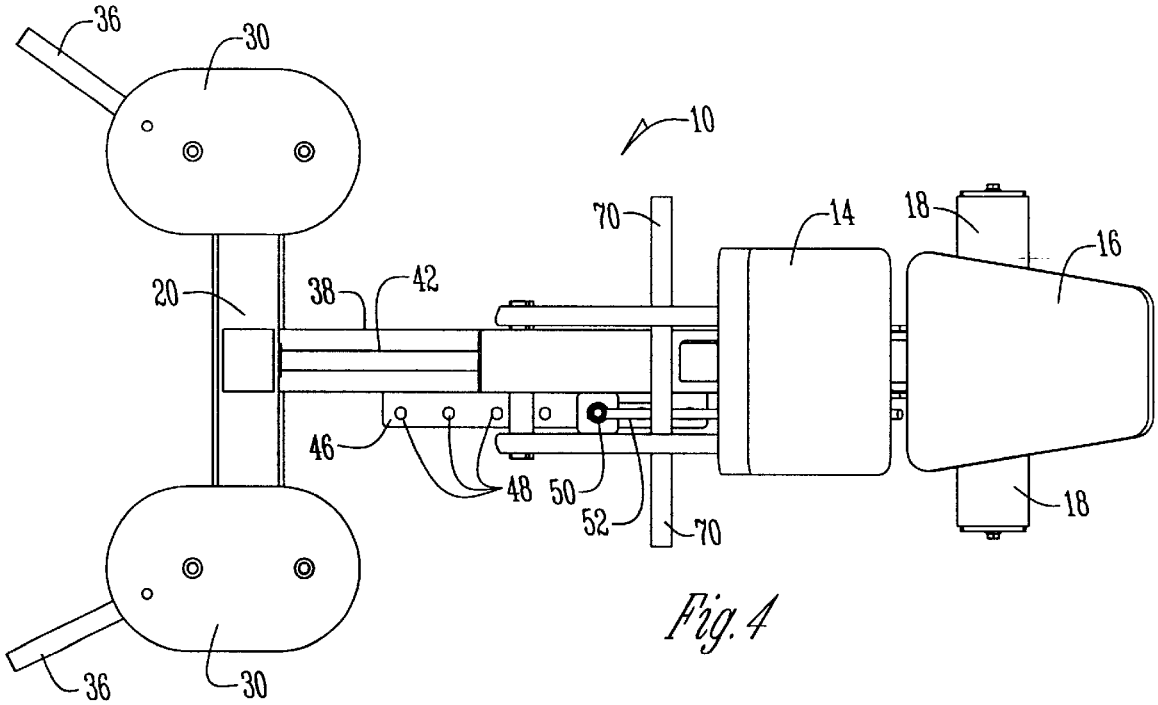
FIG. 4 is a top plan view of the bench at 80°.

The adjustable weightlifting bench of the present invention is generally designated by the reference numeral 10 in the drawings. The bench includes a base 12 upon which is mounted a backrest 14 and a seat 16. The base 12 includes a front foot 18 and a back foot 20. The front foot 18 includes wheels 22 for moving the bench into a desired location.

The base 12 further includes a rear leg 24 with a laterally extending cross beam 26 at the top of the leg 24. Brackets 28 extend over the opposite ends of the crossbeam 26, with a plate 30 connected to each of the brackets 28. The crossbeam 26, brackets 28, and plates 30 form a spotter's platform 32 upon which a spotter can stand.

A downwardly extending post is mounted on each of the plates 30, or to any other part of the spotter platform 32 or base 12. The posts 34 are adapted to be received in a corresponding collar or structure on a weightlifting rack so that the bench 10 can be connected to the rack (not shown). Handles 36 are also connected to the spotter platform 32 or to the post 34 to provide for easy lifting of the rearward end of the bench 10 for rolling the bench 10 on the wheels 22 and for installing and removing the posts 34 on the corresponding rack structure.

The base 12 also includes a pair of longitudinally extending beams 38, 40. The rear longitudinal beam 38 extends forwardly from the rear leg 24. The front longitudinal beam 40 extends rearwardly from the front foot 18. A bearing shaft 42 extends forwardly from the rear leg 24. The front beam 40 includes a collar 44 adapted to receive the shaft 42 and slide thereon, such that the front beam 40 can be extended or retracted relative to the rear leg 24. A flange 46 having a plurality of holes 48 extends from the rear beam 38. A pull pin 50 is mounted on the front beam 40 and is adapted to be received in one of the holes 48. Since the rear beam 38 is fixed relative to the rack via the rear leg 24 and connection posts 34, when the pull pin 50 is received in one of the holes 48 on the flange 46 of the rear beam 38, the front beam 40 is then set in position relative to the rack. A lever arm 52 attached to the front beam 40 is provided for easy pulling of the pin 50. Thus, when the bench 10 is used in conjunction with a weight lifting rack, the position of the backrest 14 and seat 16, which are mounted on the front beam 40 as described below, can be easily adjusted relative to the weight being lifted on the rack.

An important and novel feature of the bench 10 is the automatic and simultaneous adjustments of the backrest 14 and seat 16. The backrest 14 includes a frame 54, and the seat 16 includes a frame 56. A first support member including a pair of spaced apart plates 58 extends upwardly from the front beam 40 and is pivotally secured on each side of the backrest frame 54 by pins or bolts 60. A second support member comprises a pair of elongated arms 62 each have an upper end pivotally secured to the backrest frame 54 by pins or bolts 64. The lower ends of the arms 62 include a plurality of notches 66A–E which are adapted to be received upon a catch 68 mounted to and extending laterally across the front beam 40. A bar 70 extends through the arms 62 to tie the arms together and to provide a handle for facilitating the placement of the selected notch 66A–E onto the catch 68.

Figure 5:
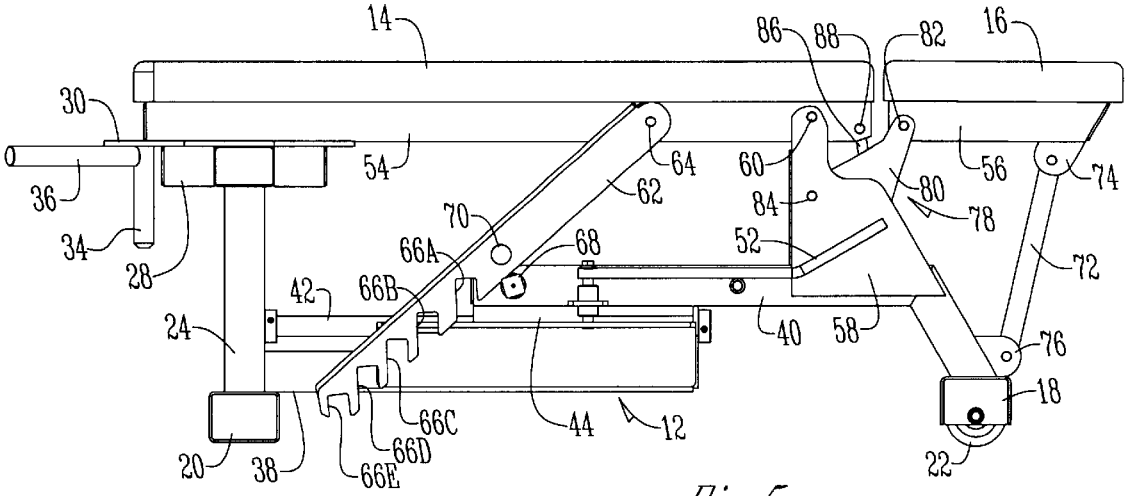
FIG. 5 is a side elevation view of the bench at zero degree.
Figure 6:
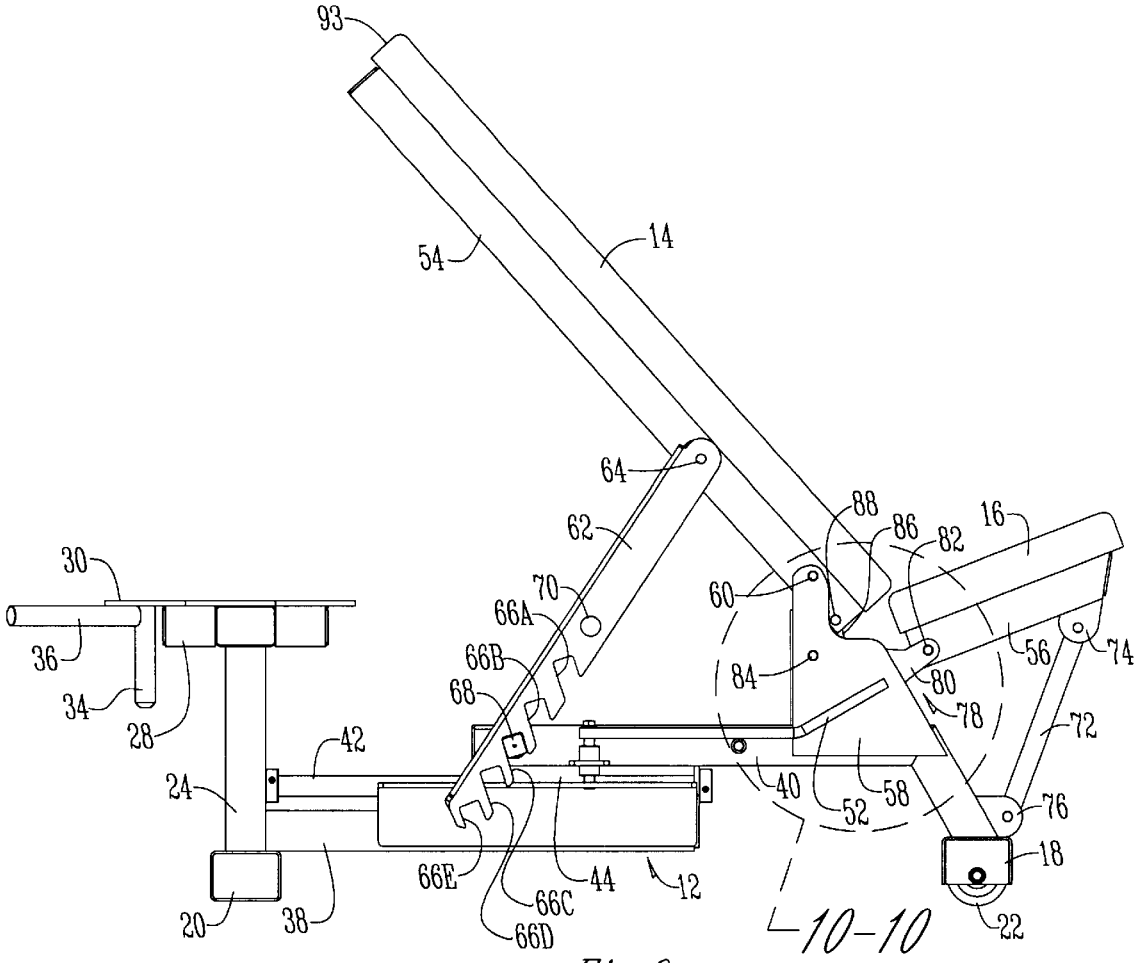
FIG. 6 is a side elevation view of the bench at 45°.
Figure 7:
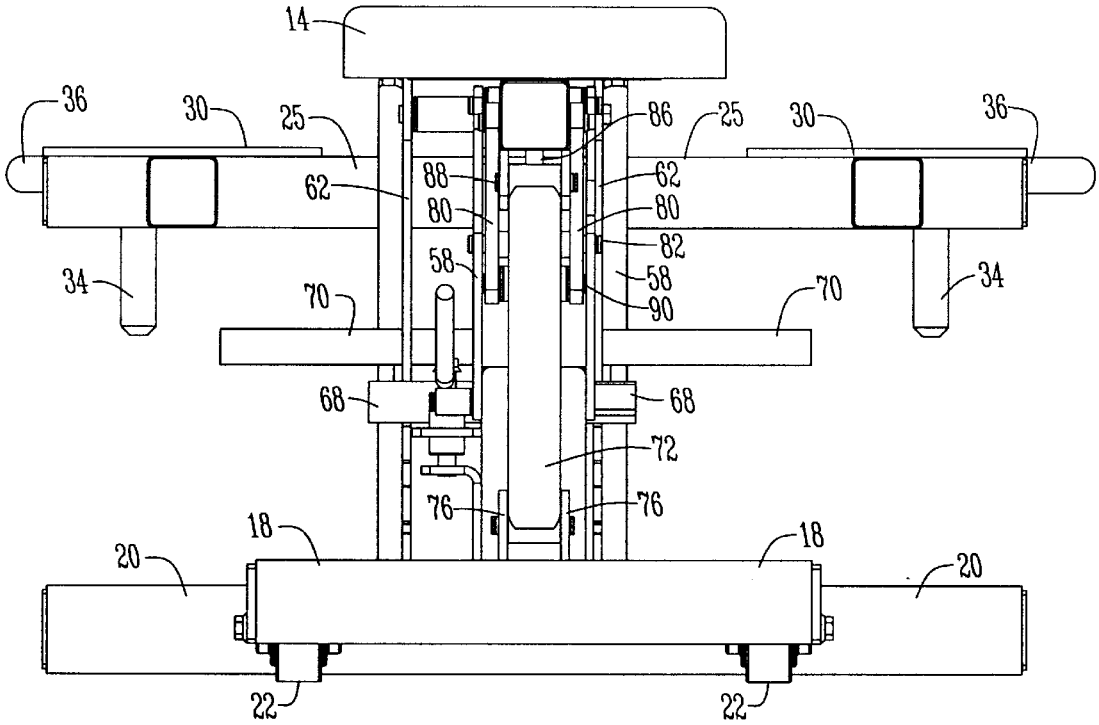
FIG. 7 is a front elevation view of the bench at zero degree.
Figure 8:
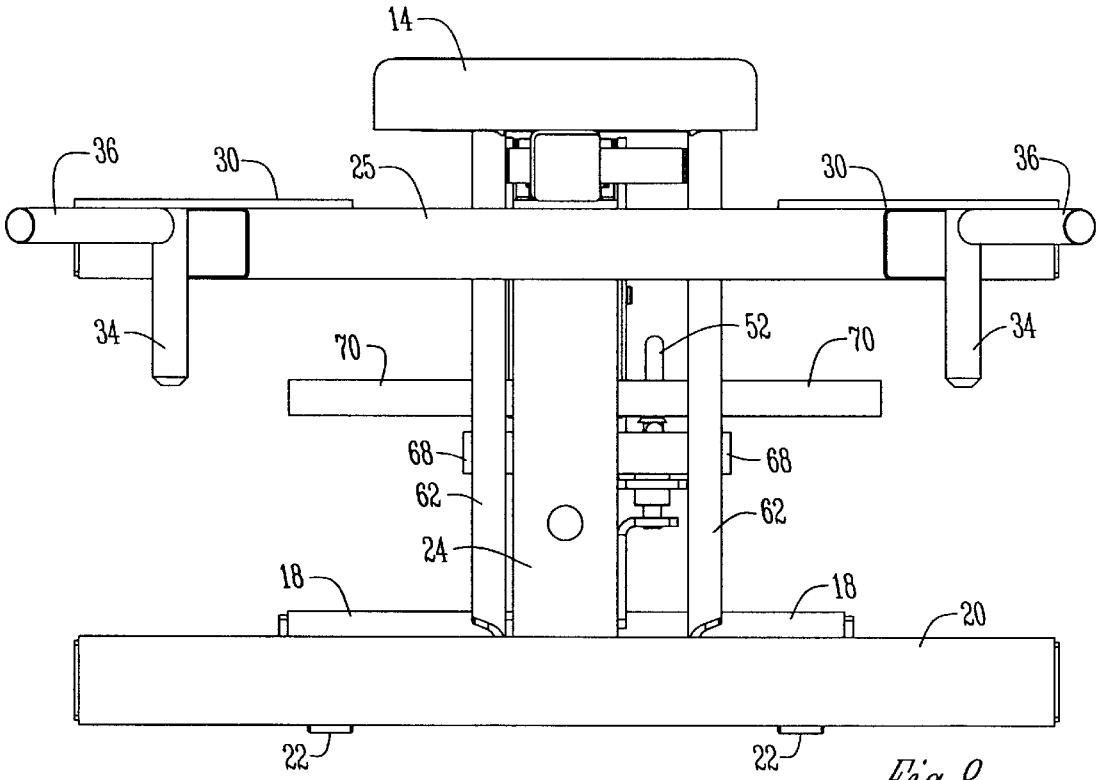
FIG. 8 is a rear elevation view of the bench at zero degree.
Figure 9:
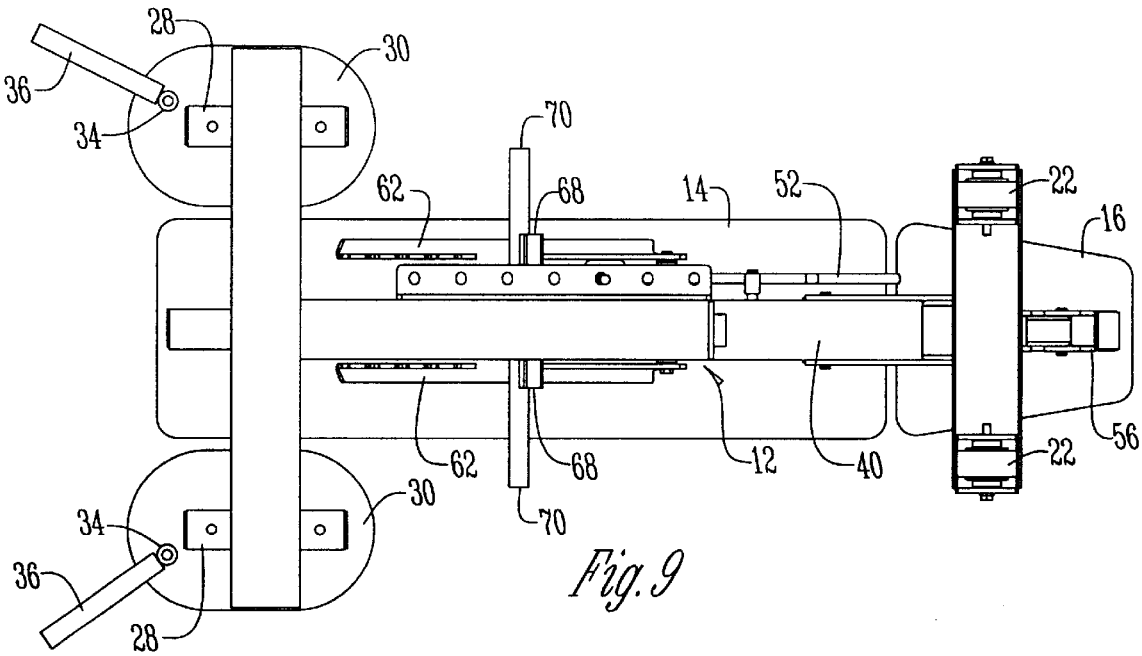
FIG. 9 is a bottom plan view of the bench at zero degree.
Figure 10:
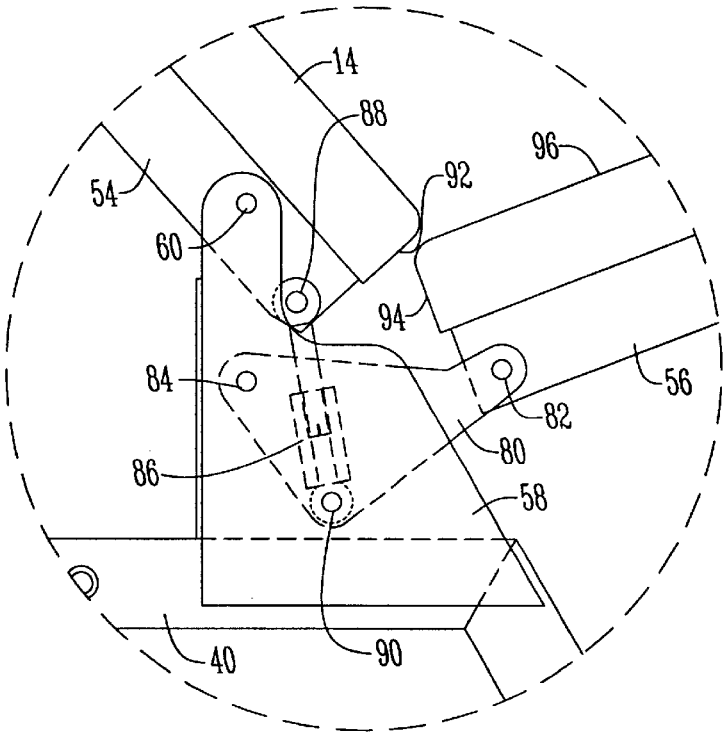
FIG. 10 is an enlarged side elevation view of the linkage assembly taken along lines 10—10 of FIG. 6.

When the arms 62 are in the lower most position, the catch 68 is above the upper most notch 66A, as best seen in FIG. 5, such that the backrest 14 and seat 16 are in a flat or zero degree position. Each sequential notch 66A–E on the arms 62 allows the backrest 14 to be moved to a greater angular position. For example, the first notch 66A preferably corresponds to an angle of 15° for the backrest 14; the second notch 66B corresponds to an angle of 35°; the third notch 66C corresponds to an angle of 45°; the fourth notch 66D corresponds to an angle of 60°; and the last notch 66E corresponds to an angle of 80°. It is understood that more or less notches can be provided to allow for more or less positions for the backrest 14, and that the notches can be positioned so as to provide different angular orientations for the backrest 14 from those recited above.

The seat 16 is pivotally supported by an arm 72. The arm 72 has an upper end pinned between a pair of ears 74 on the seat frame 56 and is pinned at its lower end to a pair of ears 76 on the front beam 40.

A linkage assembly 78 pivotally connects the seat 16 to the backrest 14. The linkage assembly 78 includes a pair of plates 80 having a forward end pivotally connected to a seat frame 56 by a pin or bolt 82. The plates 80 include a rearward end which is pinned to the support plates 58 by a pin or bolt 84. A shaft, bar or tube 86 connects the plates 80 to the backrest frame 54. The shaft 86 includes an upper end which is pivotally connected to the backrest frame 54 by a pin or bolt 88, and a lower end which is pivotally connected to the plates 80 by a pin or bolt 90. The shaft may include threadably coupled upper and lower sections to permit adjustment of the length of the shaft as needed to provide manufacturing tolerance for the connections between the backrest frame 54 and the plates 80.

The linkage assembly 78, which interconnects the backrest 14 and the seat 16, causes the seat 16 to automatically and simultaneously move in unison with the backrest 14, as the backrest 14 is raised or lowered to different angular positions. As the backrest 14 is raised upwardly from zero degrees, the backrest 14 pivots about the pin 60, with the front edge 92 moving downwardly and the rear edge 93 moving upwardly. Simultaneously, the linkage assembly 78 pivots about the pin 84 so as to pivot the rear edge 94 of the seat 16 downwardly. Also, the linkage assembly 78 maintains a maximum spacing of one-inch between the front edge 92 of the backrest 14 and the rear edge 94 of the seat 16. Furthermore, the front edge 92 of the backrest 14 is always maintained adjacent or behind the rear edge 94 of the seat 16, such that the seat surface 96 is not obstructed by the backrest 14. In other words, the linkage assembly 78 functions to prevent the backrest 14 from moving to a position over the seat surface 96, which otherwise would decrease the sitting area of the seat 16.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An adjustable bench for weightlifting, comprising:

a base for supporting the bench on a floor;

a backrest;

a seat;

a first support member extending between the backrest and the base for pivotally supporting the backrest on the base;

a second support member extending between the backrest and the base for positioning the backrest at a selected angle relative to the base;

an arm extending between the seat and the base for pivotally supporting the seat on the base; and a linkage assembly pivotally connected to the backrest, the seat and the first support member such that the seat automatically and simultaneously adjusts as the backrest is moved into position.

2. The adjustable bench of claim 1 wherein the first support member includes a pair of spaced apart plates each having a lower end fixed to the base and an upper end pivotally connected to the backrest.

3. The adjustable bench of claim 1 wherein the linkage assembly includes a pair of spaced apart plates having a forward end pivotally connected to the seat, a rearward end pivotally connected to the first support member, and a shaft having one end connected to the backrest and an opposite end connected to the plates so as to pivotally interconnect the backrest to the plates.

4. The adjustable bench of claim 1 wherein the frame includes a catch, and the second support members includes a lower end with a plurality of notches and an upper end pivotally connected to the backrest, the rack being selectively positioned with the catch received in one of the notches so as to hold the backrest in the selected position.

5. The adjustable bench of claim 1 wherein the seat has an upper surface, the upper surface of the seat being unobstructed by the backrest in all positions of the backrest.

6. The adjustable bench of claim 1 wherein the base includes wheels for moving the bench.

7. The adjustable bench of claim 1 further comprising a spotter platform on the base and extending on opposite sides of the backrest.

8. The adjustable bench of claim 1 further including one or more rack connectors on the base adapted for connecting the base to a weightlifting rack for use therewith.

9. The adjustable bench of claim 1 wherein the base includes a pair of frame members, with one frame member being longitudinally movable with respect to the other frame member, and the backrest and seat being connected to the movable frame member.

10. The adjustable bench of claim 9 wherein the base member further comprises a lever arm pivotally mounted on the movable frame member, the lever arm being operatively connected to a pull pin; and a flange operatively mounted on the other frame member, the flange having a plurality of holes adapted to receive the pull pin.

11. An adjustable bench for weightlifting, comprising:

a base;

a backrest pivotally mounted on the base for movement between a plurality of angled positions;

a seat pivotally mounted to the base for movement between a plurality of angled positions; and linkage interconnecting the backrest and seat such that the backrest and seat move simultaneously; the seat being free from obstruction by the backrest in all positions of the backrest.

12. The adjustable bench of claim 11 wherein the seat has an upper surface, the front edge of the backrest being rearward of the seat upper surface in all positions of the backrest.

13. The adjustable bench of claim 11 wherein the base includes a first support member extending upwardly and having an upper end pivotally connected to the backrest.

14. The adjustable bench of claim 13 wherein the linkage includes at least one plate with a rear end pivotally connected to the first support member and a forward end pivotally connected to the seat, and a shaft pivotally extending between the plate and the backrest.

15. The adjustable bench of claim 14 wherein the base includes a seat support member extending upwardly and having an upper end pivotally connected to the seat.

16. The adjustable bench of claim 11 further comprising a second support member extending between the backrest and the base for supporting the backrest in each of the angled positions.

17. The adjustable bench of claim 16 wherein the seat has an upper surface, the upper surface of the seat being unobstructed by the backrest in all positions of the backrest.

18. The adjustable bench of claim 11 wherein the base includes wheels for moving the bench.

19. The adjustable bench of claim 11 further comprising a spotter platform on the base and extending on opposite sides of the backrest.

20. The adjustable bench of claim 11 wherein the base includes a pair of frame members, with a first frame member being longitudinally movable with respect to a second frame member, and the backrest and seat being connected to the first frame member.

21. The adjustable bench of claim 20 wherein the second frame member includes a plurality of holes in operational relation to the first frame member and a pin adapted to be received in one of the plurality of holes so as to restrict the first frame member from longitudinal movement with respect to the second frame member.

22. The adjustable bench of claim 21 wherein the pin is operatively connected to a lever which allows a user to selectively remove or insert the pin into one of the plurality of holes.

23. An adjustable bench for weightlifting, comprising:

a base for supporting the bench on a floor;

a backrest;

a seat;

a first support member extending between the backrest and the base for pivotally supporting the backrest on the base;

a second support member extending between the backrest and the base for positioning the backrest at a selected angle relative to the base;

an arm extending between the seat and the base for pivotally supporting the seat on the base;

a linkage assembly pivotally connected to the backrest, the seat and the first support member such that the seat automatically and simultaneously adjusts as the backrest is moved to a selected position;

the linkage assembly having a plurality of pivot points sufficient such that the backrest and the seat being maintained within one inch of one another at all selected positions of the backrest.

24. The adjustable bench of claim 23 wherein the plurality of pivot points comprises five pivot points.

25. The adjustable bench of claim 1 wherein the backrest and seat are maintained within one inch of one another at all selected positions of the backrest.

* * * * *

UNITED STATES PATENT AND TRADEMARK OFFICE

CERTIFICATE OF CORRECTION

PATENT NO. : 6,605,023 B1
DATED : August 12, 2003
INVENTOR(S) : Mobley

It is certified that error appears in the above-identified patent and that said Letters Patent is hereby corrected as shown below:

Title page, Item [54] and Column 1, line 1,
Title, should be -- ADJUSTABLE WEIGHTLIFTING BENCH --.

Signed and Sealed this

Ninth Day of December, 2003

JAMES E. ROGAN
*Director of the United States Patent and Trademark Office*